US005769958A

United States Patent [19]

Reagan et al.

[11] Patent Number: 5,769,958

[45] Date of Patent: Jun. 23, 1998

[54] TANK WETTING METHOD

[75] Inventors: Gary L. Reagan; Ned C. Crawford; Gregory A. Luther, all of Knox County, Tenn.

[73] Assignee: Highway Transport, Inc., Knoxville, Tenn.

[21] Appl. No.: 570,668

[22] Filed: Dec. 11, 1995

Related U.S. Application Data

[63] Continuation-in-part of Ser. No. 242,786, May 16, 1994, abandoned.

[51] Int. Cl.[6] ..... B08B 9/093

[52] U.S. Cl. ..... 134/22.1; 134/22.18; 134/35; 134/37

[58] Field of Search ..... 134/22.1, 22.12, 134/22.18, 24, 31, 34, 35

[56] References Cited

U.S. PATENT DOCUMENTS

| | | | |
|---|---|---|---|
| 2,065,462 | 12/1936 | Olsson | 134/22.18 |
| 3,033,215 | 5/1962 | Miller | 134/98 |
| 3,188,238 | 6/1965 | Lyon | 134/24 |
| 3,281,269 | 10/1966 | Watts | 134/22 |
| 3,549,421 | 12/1970 | McFadden et al. | 134/31 |
| 3,556,407 | 1/1971 | Niikura | 239/227 |
| 3,728,157 | 4/1973 | Griparis | 134/22.18 |
| 3,860,018 | 1/1975 | Reiter | 134/22.18 |
| 4,469,143 | 9/1984 | Vazin | 141/1 |
| 4,859,249 | 8/1989 | Valentini | 134/22.18 |
| 4,874,435 | 10/1989 | Caracciolo | 134/22.18 |
| 4,902,352 | 2/1990 | Christian | 134/22.12 |
| 5,037,486 | 8/1991 | Sloan | 134/18 |
| 5,093,949 | 3/1992 | Sloan | 15/1.7 |
| 5,273,591 | 12/1993 | Perkins | 134/22.19 |
| 5,282,889 | 2/1994 | Franklin | 134/18 |

*Primary Examiner*—Jill Warden
*Assistant Examiner*—Saeed Chaudhry
*Attorney, Agent, or Firm*—Pitts & Brittian, P.C.

[57] ABSTRACT

A tank wetting method for wetting the interior of a tank of a vehicle such that residue from transported substance does not dry on interior surfaces of the tank. The tank wetting method utilizes a tank wetting appartatus (10) including an atomizing device (38) having at least one nozzle (56) disposed within the tank of the vehicle, and a reservoir (12) mounted on the vehicle for holding a liquid such as water. A liquid supply system is provided for selectively supplying water to the atomizing device (38), and an air supply system is provided for selectively supplying air to the atomizing device (38), whereby the atomizing device (38) mixes the air from the air supply system and the liquid from the reservoir (12) and injects the resulting atomized liquid into the interior of the vehicle's tank. In accordance with the method of the present invention, the substance being transported is discharged from the tank (18) of the vehicle, and the tank (18) is sealed such that the tank is substantially airtight. Air from the air brake system of the vehicle and liquid from the reservoir (12) is then simultaneously supplied to the atomizing device (38), whereby the atomizing device injects atomized liquid into the interior of the tank. The tank wetting method generally includes the steps of (1) discharging the transported substance from the tank; (2) sealing the tank such that it can be maintained in an air-tight fashion; (3) pressurizing the tank through injection of an atomized liquid; and (4) maintaining the sealed and pressurized status of the tank until delivery of the tank to a cleaning facility.

8 Claims, 6 Drawing Sheets

TANK WETTING METHOD

This application is a continuation-in-part of our U.S. patent application Ser. No. 08/242,786, filed May 16, 1994 now abandoned.

TECHNICAL FIELD

This invention relates an apparatus and method for wetting the interior of the tank of a vehicle such as a tank truck, or tank trailer drawn by a tractor, to prohibit residue from off-loaded substances from drying on the interior surfaces of the tank prior to cleaning. In this particular invention the wetting apparatus includes a water reservoir, an air supply system and an atomizing device for providing atomized water to the interior of the tank and developing a predetermined amount of pressure therein.

BACKGROUND ART

It is common for latex emulsions, such as paints and textile products, and other water based chemicals, to be transported in the tanks of tank trailers pulled by tractors, or in the tanks of tanker trucks. Transporting such substances over the highways by truck is fast and efficient. However, once latex emulsions, and certain other water based chemicals, are off-loaded, the residue of the substances which clings to the interior surfaces of the tank tends to dry rapidly. As a result, by the time the vehicle reaches a facility with the equipment necessary to properly clean the tank, the residue has generally dried and hardened on the surfaces of the tank. In this regard, caustic cleaning or other chemicals are usually necessary to remove the residue, and cleaning is otherwise difficult, time consuming and expensive.

Certain mechanisms have been devised to facilitate the cleaning of tanks in which chemical substances are transported or stored. For example, U.S. Pat. No. 3,188,238 discloses a tank cleaning method and apparatus which utilizes cleaning fluids to immediately clean a tank after a chemical substance is drained from the tank. However, the method and apparatus of the '238 patent is not particularly well suited for cleaning the interior of a tank where latex emulsions have been transported, and a second, more through cleaning is generally necessary at a fixed cleaning facility. Between the preliminary cleaning in the field and the subsequent cleaning at a cleaning facility any residue in the tank is permitted to dry within the tank. Accordingly, attempting to clean the tank in the field has not solved the problem. Other cleaning devices of interest are disclosed in U.S. Pat. Nos. 5,282,889; 5,273,591; 5,093,949; 5,037,486; 4,902,352; 4,874,435; 4,859,249; 4,469,143; 3,556,407; 3,549,421; 3,281,269; 3,188,238; and 3,033,215.

Therefore, it is an object of the present invention to provide a tank wetting apparatus and method for wetting the interior of a tank to prohibit the drying of residue from water based chemicals so as to facilitate subsequent cleaning of the tank at a cleaning facility. Waste minimization will result through reduction of caustic cleanings, as water rinses will be used in place of caustic cleanings.

It is another object of the present invention to provide a tank wetting apparatus and method which can be used immediately after the unloading of the substance being transported.

Yet another object of the present invention is to provide a tank wetting apparatus which is inexpensive to manufacture and maintain, and an associated tank wetting method which is easy and inexpensive to use.

DISCLOSURE OF THE INVENTION

Other objects and advantages will be accomplished by the present invention which provides a tank wetting apparatus and method for wetting the interior of a tank of a tank vehicle such that residue from substances transported in the tank do not dry on interior surfaces of the tank prior to cleaning. The tank wetting apparatus includes an atomizing device having a nozzle disposed within the tank of the vehicle, and a reservoir mounted on the vehicle for holding water for wetting the interior of the tank. The reservoir is provided with a heating mechanism for selectively heating the water in the reservoir. The heating mechanism includes a heating element which extends into the reservoir and through which heated coolant from the cooling system of the internal combustion engine of the operatively associated vehicle is selectively passed. The apparatus also includes an air supply system for selectively supplying air to the atomizing device, the air supply system including an air supply line for communicating air from the air brake system of the vehicle to the atomizing device. Also included is a water supply system for selectively supplying water from the reservoir to the atomizing device. The water supply system includes a pneumatically actuated pump selectively driven by air from the air brake system of the vehicle and a liquid supply line for establishing fluid communications between the pump and the atomizing device, whereby the atomizing device mixes the air from the air supply system and the water from the reservoir and injects the resulting atomized water into the interior of the tank.

In accordance with the method of the present invention, the substance being transported is discharged from the tank of the vehicle, and the tank is sealed such that it is substantially air-tight. Air from the air brake system of the vehicle and liquid from a reservoir is then simultaneously supplied to the atomizing device, whereby the atomizing device injects atomized liquid into the interior of the tank. This suspends the atomized water under pressure. The sealed condition of the tank allows the wetted condition of the tank interior to be maintained until the vehicle can be driven to a location for cleaning.

BRIEF DESCRIPTION OF THE DRAWINGS

The above mentioned features of the invention will be more clearly understood from the following detailed description of the invention read together with the drawings in which.

BEST MODE FOR CARRYING OUT THE INVENTION

Figure 1:
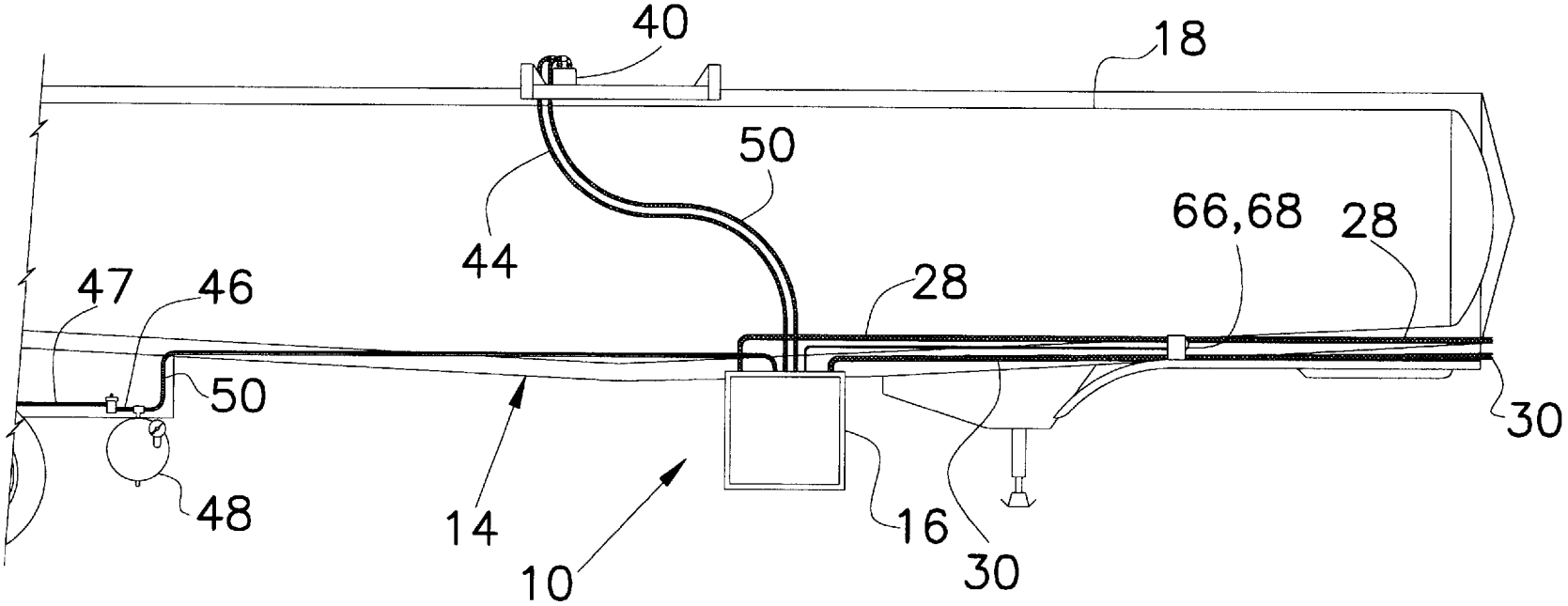
FIG. 1 illustrates a side elevation view of a tank wetting apparatus of the present invention mounted on a tank trailer.
Figure 2:
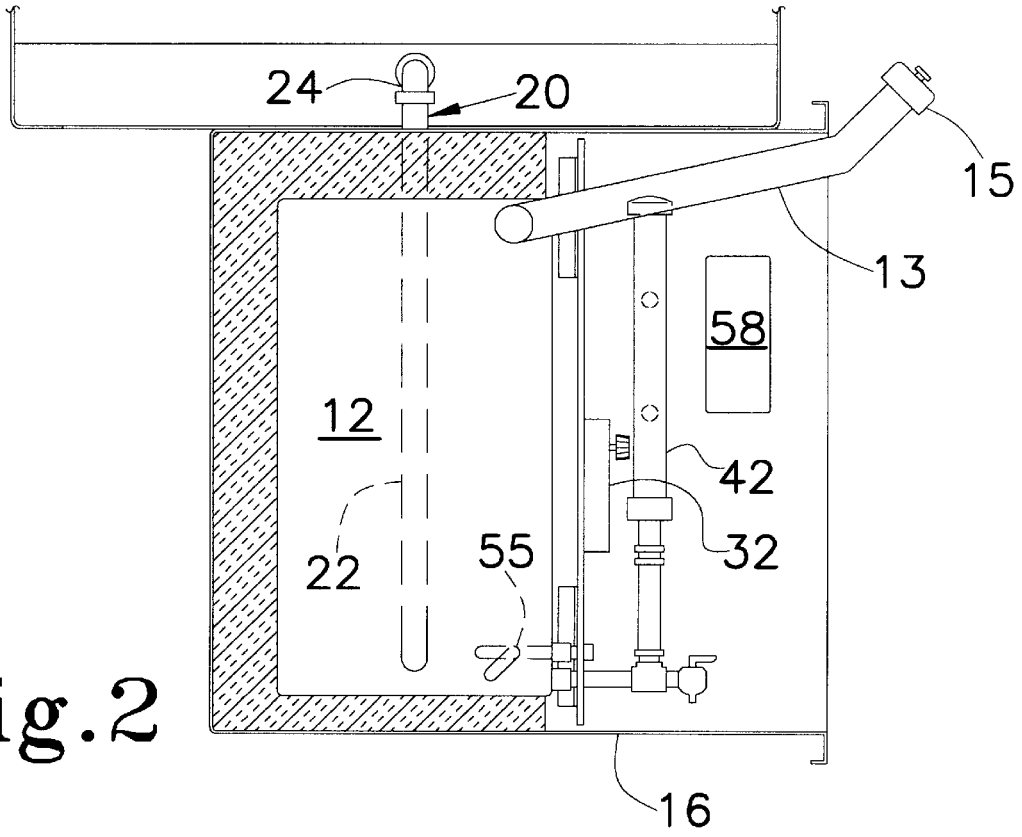
FIG. 2 illustrates a side elevation view, in section, of the liquid reservoir of a tank wetting apparatus of the present invention.

A tank wetting apparatus incorporating various features of the present invention is illustrated generally at 10 in FIGS. 1 and 2. FIG. 1 illustrates the tank wetting apparatus 10 as mounted on a tank trailer, the tank trailer being of a type commonly pulled by a conventional tractor (not shown) powered by a liquid-cooled internal combustion engine. It will, however, be understood that the tank wetting apparatus 10 can be mounted on various vehicles having one or more tanks for transporting liquid substances. Further, whereas the wetting apparatus 10 is discussed below with respect to injecting atomized water into a tank to wet the interior of such tank, it will be understood that liquids other than water can be used in conjunction with the apparatus.

Figure 3:
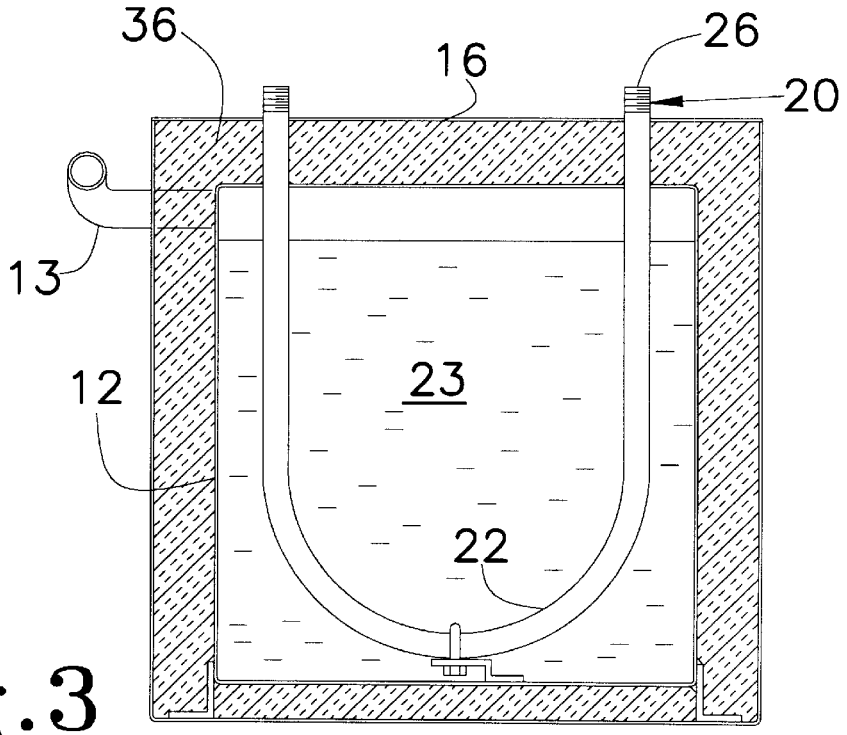
FIG. 3 illustrates a front elevation view, in section, of the liquid reservoir of a tank wetting apparatus of the present invention.

In accordance with the tank wetting method of the present invention, the water or other liquid used in the wetting operation is carried on board the operatively associated tank trailer such that the wetting process can be performed at locations where an external source of water is not available. In this regard, the tank wetting apparatus 10 includes a liquid reservoir 12 (see FIG. 2 and 3) which is mounted on the tank trailer 14 for holding the water, or other liquid, which is used in the wetting operation. More specifically, in the preferred embodiment the reservoir 12 is mounted within a control cabinet 16 secured to the tank trailer 14 at a readily accessible location. The reservoir 12 is provided with a filling tube 13 to facilitate the filing of the reservoir 12, and a removable cap 15 is provided for selectively sealing the filling tube 13. In the preferred embodiment the reservoir 12 accommodates approximately 30 gallons of water, or other liquid. However, the size of the reservoir may vary depending upon the size of the tank 18 carried by the tank trailer.

For the wetting operation it is desirable for the temperature of the water within the reservoir to be between 40° F. and 90° F.

Therefore, the reservoir 12 is provided with a heating mechanism 20 for selectively heating the water within the reservoir 12 to a desired temperature when necessary.

Figure 5:
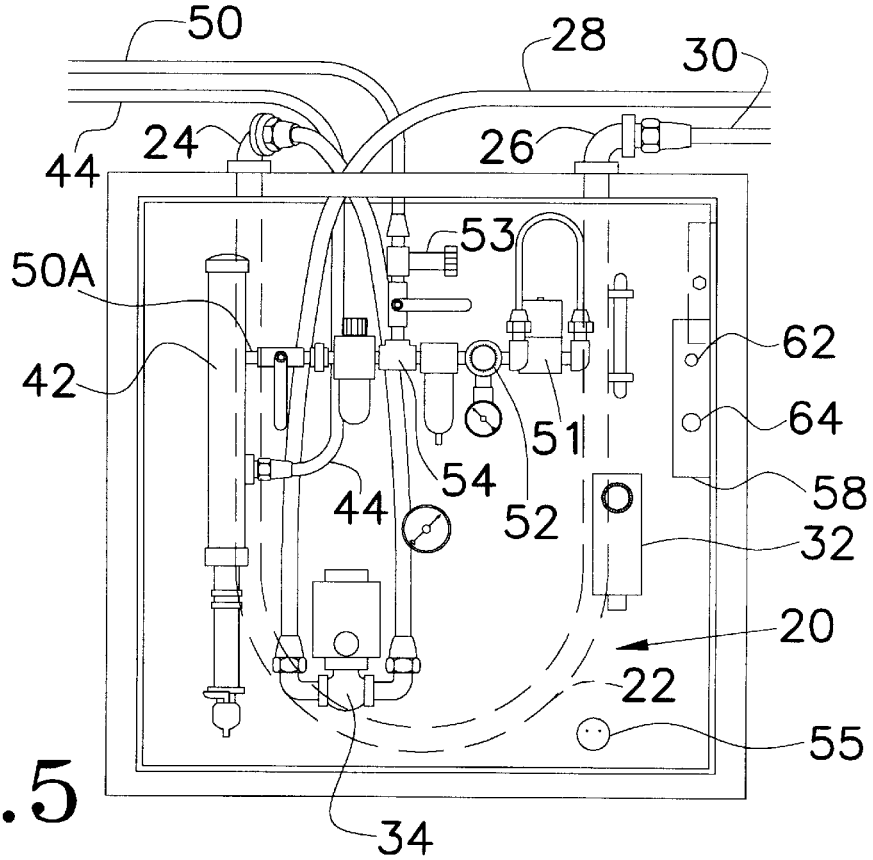
FIG. 5 illustrates a front elevation view, in section, of the control cabinet of a tank wetting apparatus of the present invention.

In the preferred embodiment the heating mechanism 20 utilizes heated coolant from the cooling system of the internal combustion engine of the operatively associated tractor to generate heat within reservoir 12. In this regard, the heating mechanism 20 includes a heating element 22 which extends into the reservoir 12 and the water 23 contained therein. (See FIG. 2 and 3). The heating element 22 has first and second ports 24 and 26, respectively, which are externally disposed with respect to the reservoir. As illustrated in FIG. 1 and 5, a supply line 28 is provided for placing the first port 24 in fluid communication with the cooling system of the tractor engine, and a return line 30 is provided for placing the second port 26 in fluid communication with such cooling system. Accordingly, heated coolant from the cooling system is supplied to the heating element 22 via the supply line 28, passes through the element 22, and is returned to the cooling system via the return line 30. As the heated coolant passes through the heating element 22, the element is heated, and, in turn, heats the surrounding water 23 within the reservoir 12.

Figure 4:
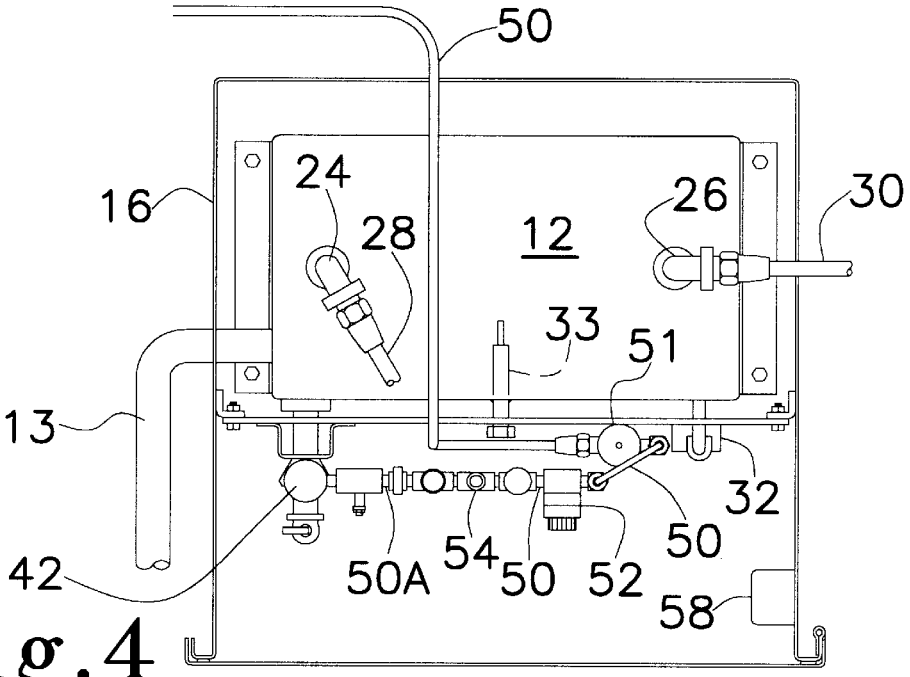
FIG. 4 illustrates a plan view, in section, of the control cabinet of a tank wetting apparatus of the present invention.

In order to insure that the liquid within the reservoir 12 is maintained at the desired temperature, the heating mechanism incorporates a temperature regulating mechanism. As illustrated in FIGS. 4 and 5, in one preferred embodiment the temperature regulating mechanism includes a temperature sensing device 32 having a probe 33 for sensing the temperature of the water 23 and which-selectively actuates a coolant shut off valve 34. For example, in one preferred embodiment the temperature sensing device 32 comprises a Honeywell® T675A-1540 temperature control, and the valve 34 comprises a Magnatrol solenoid valve. The valve 34 is located up stream from the first port 24 of the heating element 22, on the supply line 28. When the temperature of the water 23 is below the desired temperature the valve 34 is maintained in an open position, thereby allowing heated coolant to flow through the heating element 22. When the temperature of the water reaches or exceeds the desired temperature value the valve 34, actuated by the sensing device 32, closes, thereby terminating the flow of heated coolant to the heating element 22.

The heating element 22 is preferably fabricated of a metal, or other durable, thermally conductive material. The lines 28 and 30 are preferably fabricated from braided Teflon® tubing. However other durable, heat resistant tubing can be used for the lines 28 and 30 if desired. It will also be noted that the reservoir 12 is preferably mounted in the cabinet 16 such that the walls of the reservoir 12 are selectively spaced from the walls of the cabinet 16, and insulation 36 is placed between the walls of the reservoir 12 and cabinet 16 where practicable. This disposition of the reservoir 12 reduces heat loss and facilitates the efficient heating of the water within the reservoir 12.

In accordance with the method of the present invention water 23 from the reservoir 12 is communicated to an atomizing device 38 mounted in the tank 18 through a vent port 40 located at the top of the tank 18. (See FIGS. 6 and 7). As illustrated in FIGS. 4 and 5, in order to communicate the water 23 to the atomizing device 38, the apparatus 10 includes a pump 42, which selectively pumps water 23 from the reservoir 12 to the atomizing device 38 via a water supply line 44. In the preferred embodiment, the pump 42 is a pneumatically powered piston pump which is actuated by the air supply system of the tank wetting apparatus 10 which will be described in detail below. One suitable pump is the Aro Piston Pump manufactured by ARO Corp. of Cleveland, Ohio. However, it will be understood that other pumping devices can be used if desired.

Figure 1A:
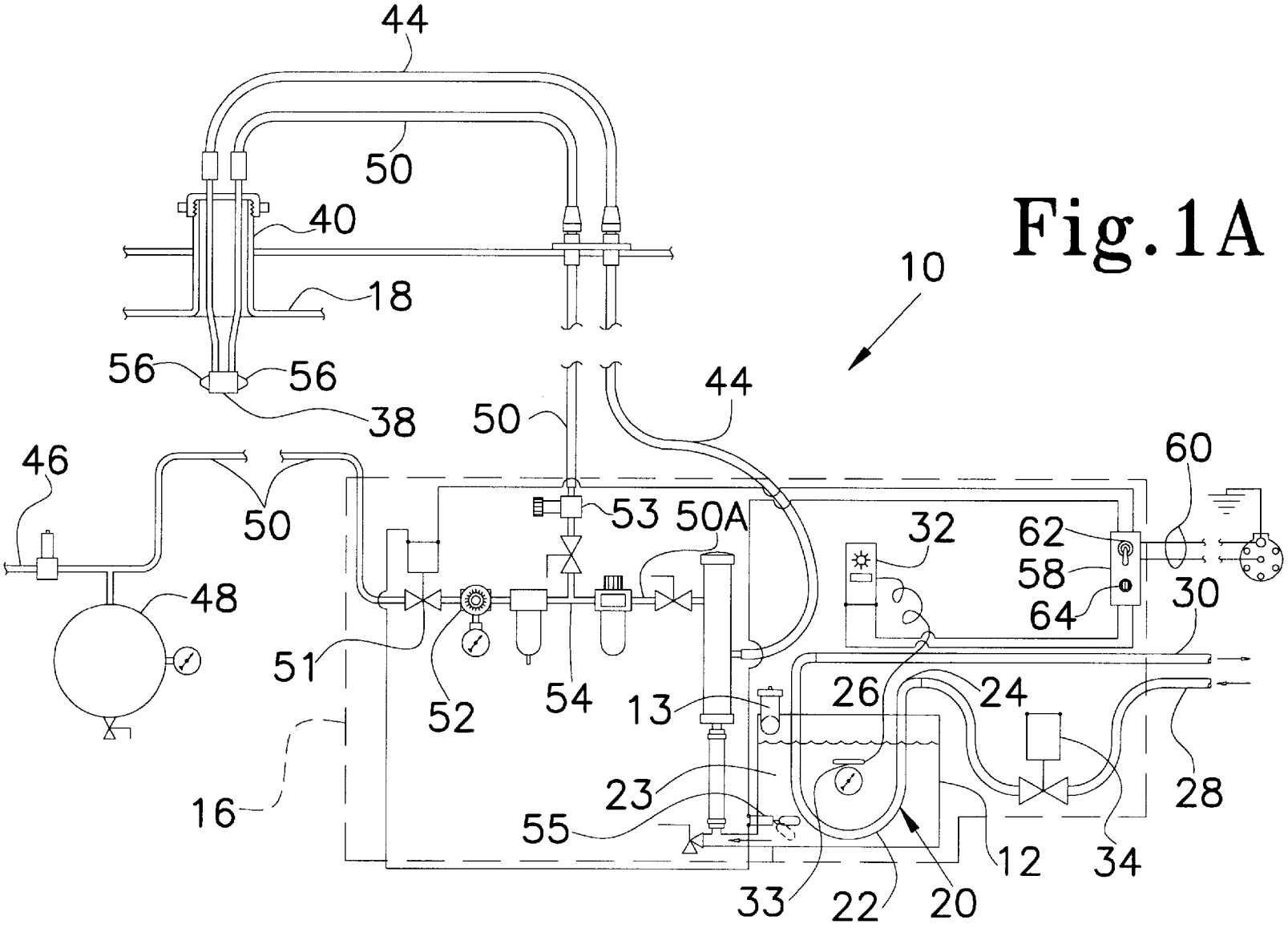
FIG. 1A illustrates schematic diagram of a tank wetting apparatus of the present invention.

As noted above, the apparatus 10 includes an air supply system which supplies air, under pressure, to the atomizing device 38 to facilitate the atomizing of the water 23. In this regard, the apparatus 10 utilizes air from the air brake system of the trailer and/or associated tractor, to accomplish the atomization of the water 23. As illustrated in FIGS. 1 and 1A, the air supply system includes an air supply line 46 which supplies air, under pressure, from the air brake system 47 to an air reservoir 48. A further air supply line 50 communicates air from the reservoir 48 to the atomizing device 38. More specifically, in the preferred embodiment the air supply line 50 is routed through the cabinet 16 (see FIGS. 1A, 4 and 5), and a shut off valve, such as the illustrated solenoid air shut off valve 51, is provided on line 50 to selectively initiate or terminate the flow of pressurized air through line 50.

In the preferred embodiment a device is provided for terminating the flow of air through air supply line 50 when the water level within the reservoir 12 falls below a selected level, thereby terminating the wetting process when substantially all of the water 23 in the reservoir 12 has been depleted. For example, in the illustrated embodiment a float operated electrical switch 55 is mounted proximate the bottom of the reservoir 12 which is electrically connected to the shut off valve 51 (see FIG. 8). When the level of water 23 in the reservoir 12 falls below the level of the switch actuator of the switch 55, the switch 55 actuates the shut off valve 51, thereby automatically terminating the wetting operation.

The air supply system also includes an air pressure regulator 52 and an adjustable pressure protection valve 53 on the line 50 down stream from the shut off valve 51. In this regard, it is desirable that air be supplied to the atomizing device 38 at between 40 and 60 psi. The air pressure regulator 52 allows regulation of the air pressure in the line 50 such that air is provided to the atomizing device 38 at the desired pressure.

It will also be noted that a junction 54 is provided in the air supply line 50, and a further air supply line 50A is provided to supply air from line 50 at junction 54 to the pump 42 in order to drive the pump 42. Thus, air from the air brake system of the trailer not only supplies air for the atomization process, but supplies air to drive the pneumatic pump 42 which communicates water from the reservoir 12 to the atomizing device 38.

Figure 6:
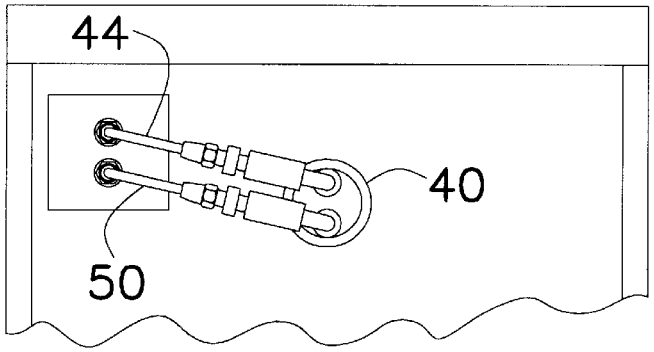
FIG. 6 illustrates a plan view of the atomizing device of a tank wetting apparatus of the present invention as it is mounted in the tank of a tank trailer.
Figure 7:
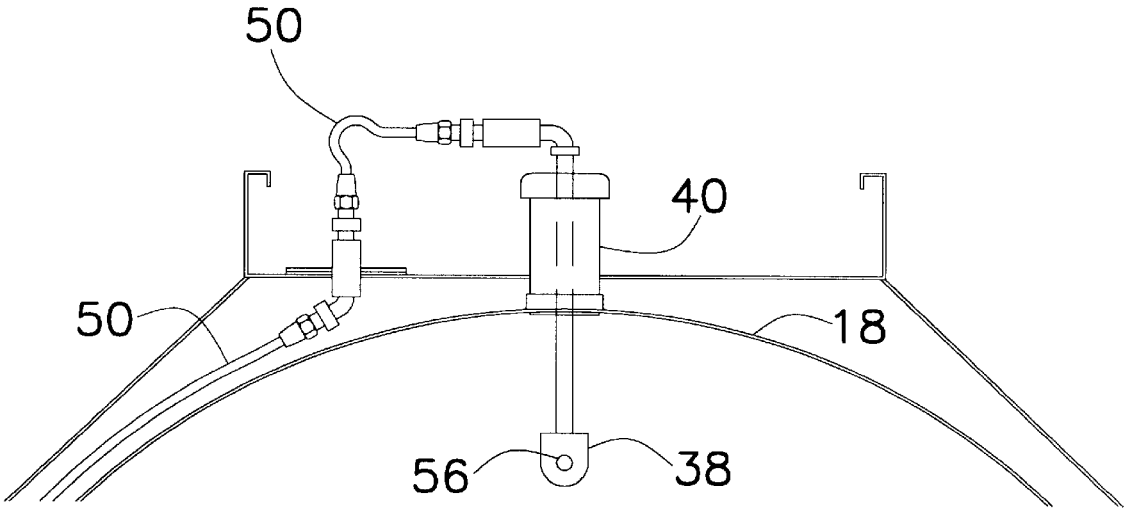
FIG. 7 illustrates a front elevation view, in section, of the atomizing device of a tank wetting apparatus of the present invention as it is mounted in the tank of a tank trailer.

As illustrated in FIGS. 1A, 6 and 7, and as mentioned above, the atomizing device 38 is mounted in the tank 18 through the vent port 40 located at the top of the tank. The water supply line 44 and the air supply line 50 selectively supply water and air, respectively, to the atomizing device 38 and the atomized water exits the atomizing device 38 through the nozzles 56. Preferably a fluid impervious seal is provided between the vent port 40 and the atomizing device 38 such that the fluid impervious integrity of the tank is not compromised, and such that a pressurized state is achieved within the tank 18 upon injection of the atomized water and can be maintained until the vehicle can be driven to a location where the cleaning can take place.

Figure 8:
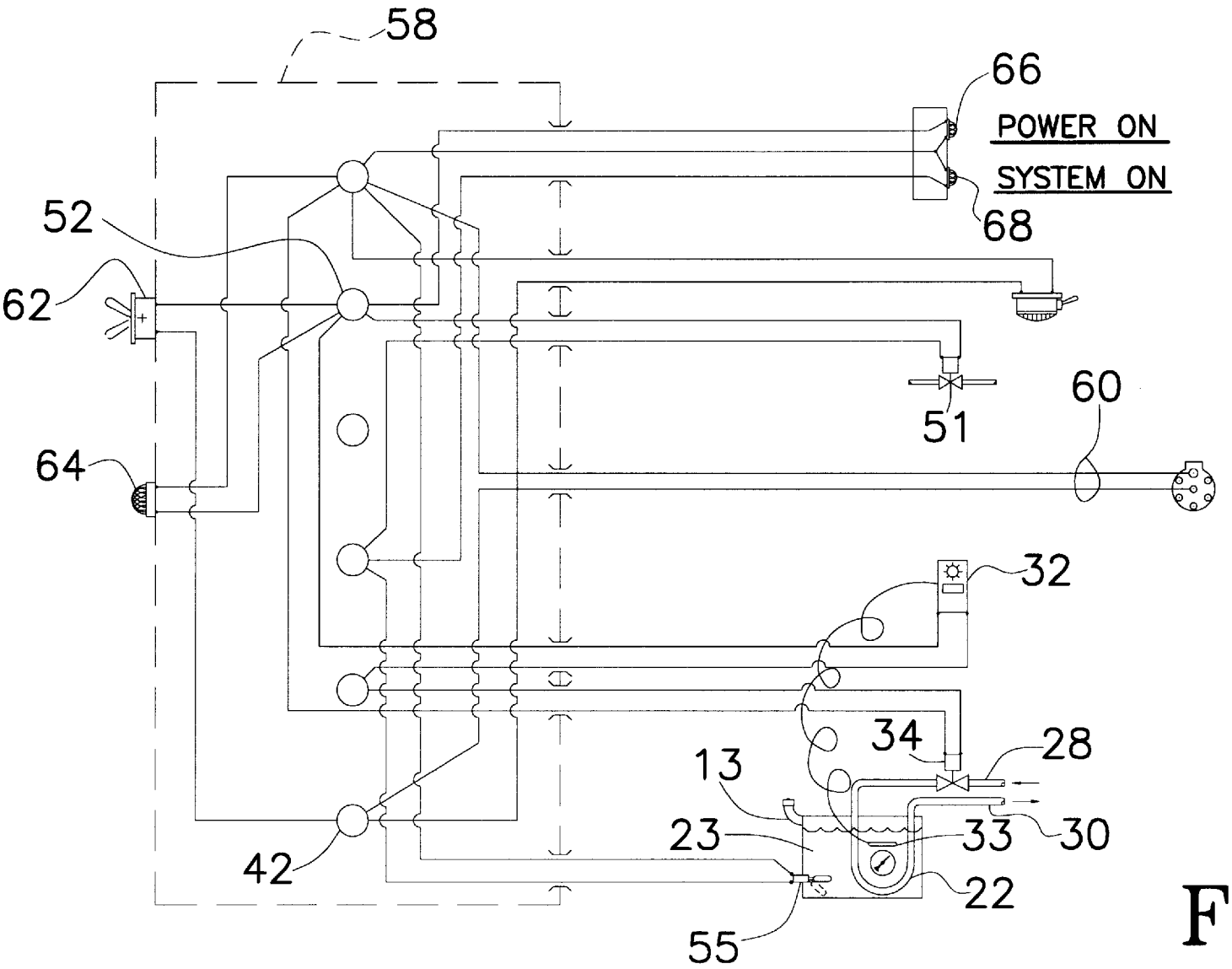
FIG. 8 illustrates schematic diagram of the electrical system of a tank wetting apparatus of the present invention.

In order to actuate the various functions of the apparatus 10, suitable electrical circuitry is provided. In FIG. 8, a schematic illustration of the one preferred electrical system is depicted. It will be noted that a junction box 58 is provided, the junction box being disposed within the control cabinet 16 as illustrated in FIGS. 4 and 5. Electrical power is supplied to the junction box 58 by an electrical cable 60 from the electrical system of the associated tractor or truck, and is fed to the various electrically powered components of the apparatus 10 from the junction box 58. It will be noted that a main on-off switch 62 for energizing the apparatus 10, and an indicator light 64 to indicate when the system is energized, are provided on the junction box 58. It will also be noted that indicator lights 66 and 68 are provided on the right side fender of the trailer 14 in the preferred embodiment. The lights 66 and 68 are positioned so as to face forward such that they can be viewed in the side rear view mirror of the associated tractor or truck when the driver is seated in the driver's seat.

In accordance with the method of the present invention the tank wetting operation is accomplished by first heating the water 23 within the reservoir 12 to the desired temperature. It will be noted that the temperature of the water 23 may already be within the desired temperature range, making it unnecessary to heat the water 23. The air shut off valve 51 is then actuated to commence the follow of air to the atomizer device 38, and so as to pneumatically power the pump 42, thereby directing the flow of water 23 to the atomizing device 38. The atomizing device 38 injects atomized water, under pressure, into the interior of the tank 14, thereby filling the tank 14 with atomized water. When the water 23 within the reservoir 12 is depleted the float operated electrical switch 55 actuates the shut off valve 51 so as to terminate the wetting operation.

In the preferred application of the method of the present invention the injection of the atomized water raises the pressure within the tank to between 1 and 5 psi. The pressurized status of the tank is maintained until the vehicle reaches the a cleaning facility in order to maintain the moisture level within the tank. Maintaining the pressurized state within the tank, and, thus, the moisture level within the tank, insures that residue within the tank is not allowed to dry.

Since the water necessary for the wetting operation is carried in the reservoir 12, and the wetting apparatus 10 relies on systems available on the associated tractor and/or trailer, for air, heat and electrical power, the wetting operation can be performed immediately after the contents of the tank 14 have been unloaded. Accordingly, the atomized water can be introduced into the tank 14 before residue from latex emulsions or other water based substances can dry on the interior of the tank 14, and the atomized water within the tank delays the drying of such substances to allow the tank trailer to be delivered to a location having proper facilities for cleaning the tank 14. Since the tank 14 is maintained in a sealed condition until cleaning is imminent, the residue within the tank 14 is not allowed to dry prior to cleaning, the cleaning operation is greatly simplified. Therefore, unlike methods utilized hereto for, no attempt is made to clean the tank 14 in the field. Instead, the tank 14 is sealed and wetted to prohibit the drying of residue on the interior walls of the tank 14 to facilitate the later cleaning of the tank 14 at a facility which is equipped to accomplish a thorough cleaning.

In light of the above it will be recognized that the present invention provides a tank wetting apparatus and method which great advances the art. However, while a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. A tank wetting method for use with a vehicle having a tank defining an interior for transporting substances, the interior being defined by interior surfaces, having an air brake system, and having an internal combustion engine for effecting travel of the vehicle, the internal combustion engine including a cooling system for cooling the internal combustion engine, said tank wetting method being for wetting the interior surfaces of the tank of the vehicle such that residue in the tank from a transported substance does not dry on the interior surfaces of the tank prior to cleaning, said method comprising the steps of:

discharging the transported substance from the tank of the vehicle;

sealing the tank of the vehicle such that the tank can be maintained in an air-tight condition;

pressurizing the tank to a selected pressure by injecting an atomized liquid into the tank, the liquid being atomized by simultaneously supplying air from the air brake system of the vehicle and a liquid from a reservoir mounted on the vehicle to an atomizing device having at least one nozzle disposed in the tank whereby the atomized liquid wets the interior surfaces of the tank and the atomizing and pressurizing of the tank to the selected pressure which prohibits residue from the transported substance from drying on the interior surfaces of the tank prior to cleaning; and maintaining the sealed and pressurized status of the tank until the cleaning of the tank.

2.The method of claim 1, and before the step of pressurizing the tank to a selected pressure by injecting an atomized liquid into the tank, wherein said method includes the futher step of heating the liquid in the reservoir mounted on the vehicle to a selected temperature using a heating element heated by heated coolant from the cooling system of the vehicle.

3. The method of claim 2 wherein the liquid supplied to the atomizing device is water.

4.The method of claim 1 wherein said step of pressurizing the tank to a selected pressure by injecting an atomized liquid into the tank includes utilizing air from the brake system of the vehicle to drive a pump for supplying the liquid to the atomizing device.

5. A tank wetting method for use with a vehicle having a tank defining an interior for transporting substances, the interior being defined by interior surfaces, having an air brake system, and having an internal combustion engine for effecting travel of the vehicle, the internal combustion engine including a cooling system for cooling the internal combustion engine, said tank wetting method being for wetting the interior surfaces of the tank of the vehicle such that residue in the tank from a transported substance does not dry on the interior surfaces of the tank prior to cleaning, said method comprising the steps of:

discharging the transported substance from the tank of the vehicle;

sealing the tank of the vehicle such that the tank is maintained in an air-tight condition prior to cleaning of the tank;

pressurizing the tank to a selected pressure by injecting an atomized liquid into the tank, the liquid being atomized by simultaneously supplying air from the air brake system of the vehicle and a liquid from a reservoir mounted on the vehicle to an atomizing device having at least one nozzle disposed in the tank whereby the atomized liquid wets the interior surfaces of the tank and the atomizing and pressurizing of the tank to the selected pressure which prohibits residue from the transported substance from drying on the interior surfaces of the tank prior to cleaning; and de-pressurizing the tank immediately prior to the cleaning of the tank.

6.The method of claim 5, and before the step of pressurizing the tank to a selected pressure by injecting an atomized liquid, wherein said method includes the further step of heating the liquid in the reservoir mounted on the vehicle to a selected temperature using a heating element heated by heated coolant from the cooling system of the vehicle.

7. The method of claim 6 wherein the liquid supplied to the atomizing device is water.

8. A tank wetting method for use with a vehicle having a tank defining an interior for transporting substances, the interior being defined by interior surfaces, having an air brake system, and having an internal combustion engine for effecting travel of the vehicle, the internal combustion engine including a cooling system for cooling the internal combustion engine, said tank wetting method being for wetting the interior surfaces of the tank of the vehicle with water such that residue in the tank from a transported substance does not dry on the interior surfaces of the tank prior to cleaning, said method comprising the steps of:

heating the water in a reservoir mounted on the vehicle to a selected temperature using a heating element heated by heated coolant from the cooling system of the vehicle;

discharging the transported substance from the tank of the vehicle;

sealing the tank of the vehicle such that the tank is maintained in an air-tight condition prior to cleaning of the tank;

pressurizing the tank to a selected pressure by injecting atomized water into the tank, the water being atomized by simultaneously supplying air from the air brake system of the vehicle and water from the reservoir mounted on the vehicle to an atomizing device having at least one nozzle disposed in the tank whereby the atomized liquid wets the interior surfaces of the tank and the atomizing and pressurizing of the tank to the selected pressure which prohibits residue from the transported substance from drying on the interior surfaces of the tank prior to cleaning; and de-pressurizing the tank after the tank has been delivered to a cleaning facility and the cleaning of the tank is imminent.

* * * * *